US011011361B1

(12) United States Patent
Yoshinari et al.

(10) Patent No.: US 11,011,361 B1
(45) Date of Patent: May 18, 2021

(54) MASS SPECTROMETER AND NOZZLE MEMBER

(71) Applicant: Hitachi High-Tech Corporation, Tokyo (JP)

(72) Inventors: Kiyomi Yoshinari, Tokyo (JP); Yasushi Terui, Tokyo (JP)

(73) Assignee: Hitachi High-Tech Corporation, Tokyo (JP)

( * ) Notice: Subject to any disclaimer, the term of this patent is extended or adjusted under 35 U.S.C. 154(b) by 0 days.

(21) Appl. No.: 16/618,198

(22) PCT Filed: May 1, 2018

(86) PCT No.: PCT/JP2018/017377
§ 371 (c)(1),
(2) Date: Nov. 29, 2019

(87) PCT Pub. No.: WO2018/225423
PCT Pub. Date: Dec. 13, 2018

(30) Foreign Application Priority Data

Jun. 8, 2017 (JP) ..... JP2017-113622

(51) Int. Cl.
*H01J 49/04* (2006.01)
*H01J 49/02* (2006.01)
*H01J 49/24* (2006.01)

(52) U.S. Cl.
CPC ..... *H01J 49/0431* (2013.01); *H01J 49/022* (2013.01); *H01J 49/025* (2013.01); *H01J 49/0445* (2013.01); *H01J 49/24* (2013.01)

(58) Field of Classification Search
CPC .... H01J 49/022; H01J 49/025; H01J 49/0431; H01J 49/0445; H01J 49/24; G01N 27/62; G01N 27/622
See application file for complete search history.

(56) References Cited

U.S. PATENT DOCUMENTS 5,271,356 A 12/1993 Kling et al.
2006/0169891 A1* 8/2006 Collings ..... H01J 49/063 250/291

(Continued)

FOREIGN PATENT DOCUMENTS

JP 6-190306 A 7/1994
JP 2001-202917 A 7/2001

(Continued)

OTHER PUBLICATIONS

International Search Report (PCT/ISA/210) issued in PCT Application No. PCT/JP2018/017377 dated Jul. 31, 2018 with English translation (11 pages).

(Continued)

*Primary Examiner* — David E Smith
(74) *Attorney, Agent, or Firm* — Crowell & Moring LLP

(57) ABSTRACT

The mass spectrometer includes an ionization unit that ionizes a sample; a nozzle unit having an inflow port that is connected to the ionization unit by a flow pipe and through which the ionized sample flows, and an outflow port from which the sample flowing in flows out; a vacuum chamber that is evacuated by vacuum evacuation means and into which the sample flows from the nozzle unit; a mass analysis unit that is located downstream of a flow of the sample relative to the vacuum chamber and that selects ions from the sample; and an ion detection unit that detects the ions selected by the mass analysis unit, wherein a division portion that divides a flow of the sample is provided inside the nozzle unit, and the division portion has a tapered projection whose diameter decreases toward the outflow port.

14 Claims, 17 Drawing Sheets

(56) References Cited

U.S. PATENT DOCUMENTS

| | | | | |
|---|---|---|---|---|
| 2015/0001392 | A1* | 1/2015 | Hasegawa ..... | H01J 49/0431<br>250/288 |
| 2017/0162375 | A1* | 6/2017 | Hasegawa ..... | H01J 49/0422 |

FOREIGN PATENT DOCUMENTS

| | | | |
|---|---|---|---|
| JP | 2008-527653 | A | 7/2008 |
| JP | 2010-157499 | A | 7/2010 |
| JP | 2013-149539 | A | 8/2013 |
| JP | 2014-107012 | A | 6/2014 |
| JP | 2016-18625 | A | 2/2016 |

OTHER PUBLICATIONS

Japanese-language Written Opinion (PCT/ISA/237) issued in PCT Application No. PCT/JP2018/017377 dated Jul. 31, 2018 (seven (7) pages).

* cited by examiner

FIG. 8A
CONVENTIONAL
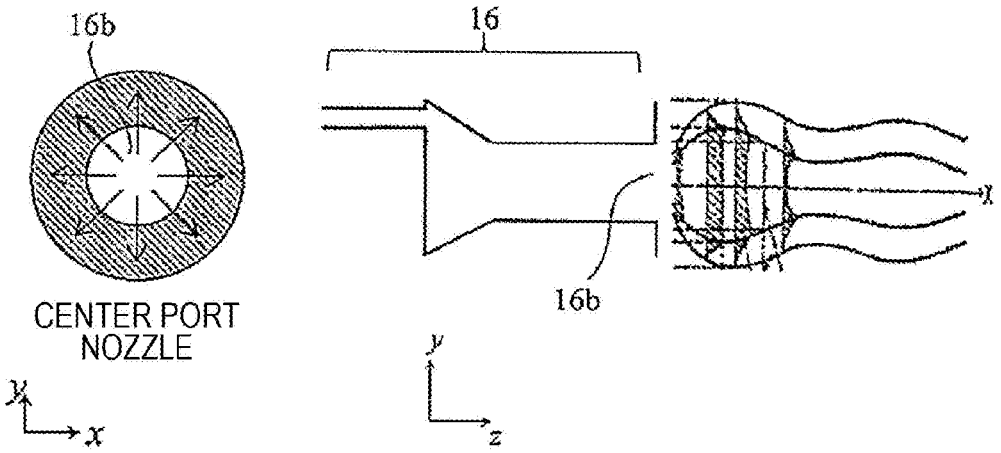
PRESENT DISCLOSURE

PRESSURE DISTRIBUTION ANALYSIS IN CONVENTIONAL NOZZLE

PRESSURE DISTRIBUTION ANALYSIS IN THE PRESENT DISCLOSURE x-y CROSS SECTION z1 x-y CROSS SECTION z2 x-y CROSS SECTION z1 x-y CROSS SECTION z2 x-y CROSS SECTION z1 x-y CROSS SECTION z2

24

MASS SPECTROMETER AND NOZZLE MEMBER

TECHNICAL FIELD

The present disclosure relates to a mass spectrometer and a nozzle member used therefor.

BACKGROUND ART

Conventionally, provided is a mass spectrometer having a multistage differential exhaust system in which one or more of intermediate vacuum chambers are provided between an ionization chamber that ionizes a sample under atmospheric pressure and an analysis chamber that selects ions under a high vacuum atmosphere. The intermediate vacuum chamber is provided with an opening serving as a flow passage of the sample gas. Since there is a large pressure difference between the ionization chamber and the intermediate vacuum chamber, when the sample gas passes through the opening and flows into the low-pressure intermediate vacuum chamber, it becomes a supersonic free jet to form a Mach disk (shock wave) and a barrel shock.

FIG. 1 is a diagram showing the structure of an expanded jet. The sample gas generates an expansion wave when moving between chambers having a large pressure difference. The Mach disk is generated when the expansion wave is reflected at the boundary of the jet and the reflected wave interferes and amplifies. That is, the Mach disk indicates a position where the jet pressure or density is high. It is presumed that if the Mach disk is repeatedly generated, the detection sensitivity of the mass spectrometer deteriorates.

PTL 1 discloses an ion transport device in which a flow straightening nozzle having a conical passage is provided outside an outlet hole of a heating pipe that sends ions from the ionization chamber to the first intermediate vacuum chamber. The ion transport device suppresses generation of the Mach disk by setting the diameter of the circular opening of the nozzle to be smaller than the diameter of the Mach disk formed by the supersonic free jet when assuming that there is no nozzle.

CITATION LIST

Patent Literature

PTL 1: JP 2010-157499 A

SUMMARY OF INVENTION

Technical Problem

The shape of the boundary of the supersonic free jet changes depending on the ratio between the pressure in the ionization chamber and the pressure in the intermediate vacuum chamber. Therefore, in the ion transport device described in PTL 1, the diameter of the circular opening of the nozzle is designed based on the pressure ratio. Therefore, in the invention described in PTL 1, there is a possibility that generation of the Mach disk cannot be sufficiently suppressed if the pressure in the ionization chamber and the first intermediate vacuum chamber changes after the device is completed.

On the other hand, when the mass spectrometer performs mass spectrometry that requires high sensitivity, such as analysis of in vivo samples, generation of the Mach disk needs to be sufficiently suppressed.

The present disclosure has been made in view of the above points, and provides a technique capable of suppressing generation of the Mach disk over a wide range of operating conditions of a mass spectrometer.

Solution to Problem

As one of the representative inventions to solve the above problem, provided is a mass spectrometer including an ionization unit that ionizes a sample, a nozzle unit having an inflow port that is connected to the ionization unit by a flow pipe and through which the ionized sample flows, and an outflow port from which the sample flowing in flows out, a vacuum chamber that is evacuated by vacuum evacuation means and into which the sample flows from the nozzle unit, a mass analysis unit that is located downstream of a flow of the sample relative to the vacuum chamber and that selects ions from the sample, and an ion detection unit that detects the ions selected by the mass analysis unit, wherein a division portion that divides a flow of the sample is provided inside the nozzle unit, and wherein the division portion has a tapered projection whose diameter decreases toward the outflow port.

As another representative invention, provided is a nozzle member used in a mass spectrometer, wherein the nozzle member has an inflow port into which an ionized sample flows and an outflow port from which the sample flowing in flows out, and a division portion that divides a flow of the sample is provided inside the nozzle unit, and wherein the division portion has a taper-shaped projection whose diameter decreases toward the outflow port.

Furthermore, as another representative invention, provided is a mass spectrometer including an ionization unit that ionizes a sample, a nozzle unit having an inflow port that is connected to the ionization unit by a flow pipe and through which the ionized sample flows, and an outflow port from which the sample flowing in flows out, a vacuum chamber that is evacuated by vacuum evacuation means and into which the sample flows from the nozzle unit, a mass analysis unit that is located downstream of a flow of the sample relative to the vacuum chamber and that selects ions from the sample, and an ion detection unit that detects the ions selected by the mass analysis unit, wherein the nozzle unit has, inside thereof a division portion that divides a flow of the sample, and wherein the division portion causes the divided flow of the sample to cross and flow into the vacuum chamber.

This specification includes the disclosure of Japanese Patent Application No. 2017-113622, which is the basis of the priority of the present application.

Advantageous Effects of Invention

According to the present disclosure, it is possible to suppress generation of the Mach disk with respect to a wide range of operating conditions of the mass spectrometer. Problems, configurations, and effects other than those described above will become apparent from the following description of embodiments.

BRIEF DESCRIPTION OF DRAWINGS

FIGS. 8A and 8B are diagrams in which the flows of samples are compared.

DESCRIPTION OF EMBODIMENTS

Figure 1:
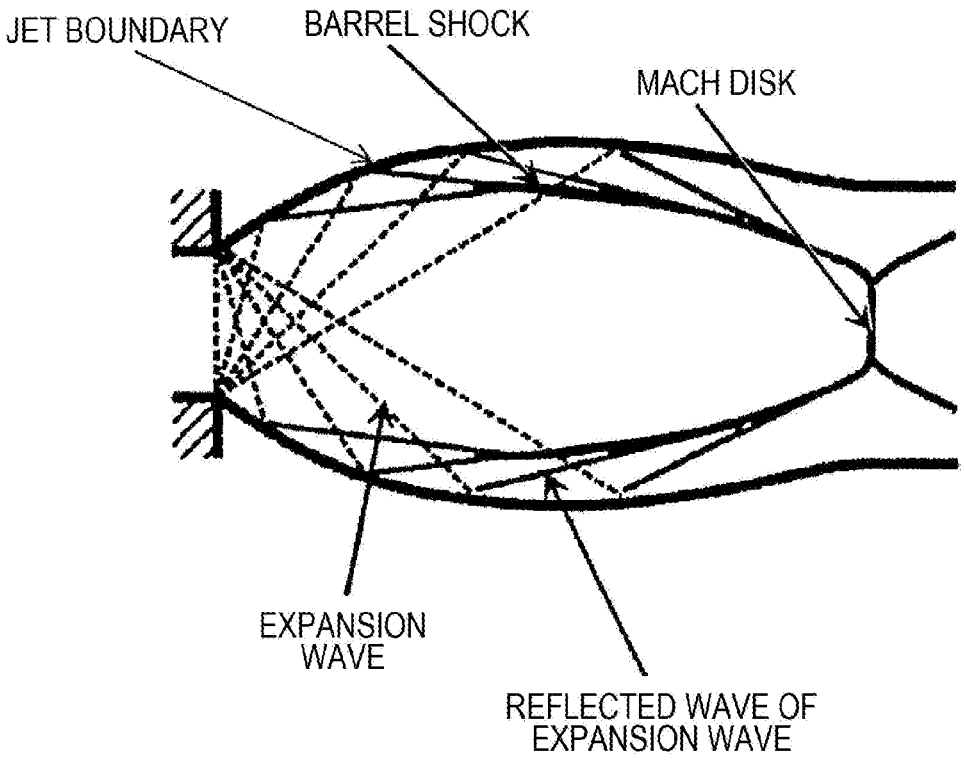
FIG. 1 is a diagram showing a structure of an expanded jet.

Hereinafter, an embodiment of the present disclosure will be described based on the drawings. In addition, embodiments of this disclosure are not limited to the embodiments mentioned later, and a various modifications are possible in the range of the technical idea. Corresponding portions in each drawing used for the description of each embodiment to be described later are denoted by the same reference numerals, and redundant description is omitted.

Embodiments

[Configuration of Mass Spectrometer]

Figure 2:
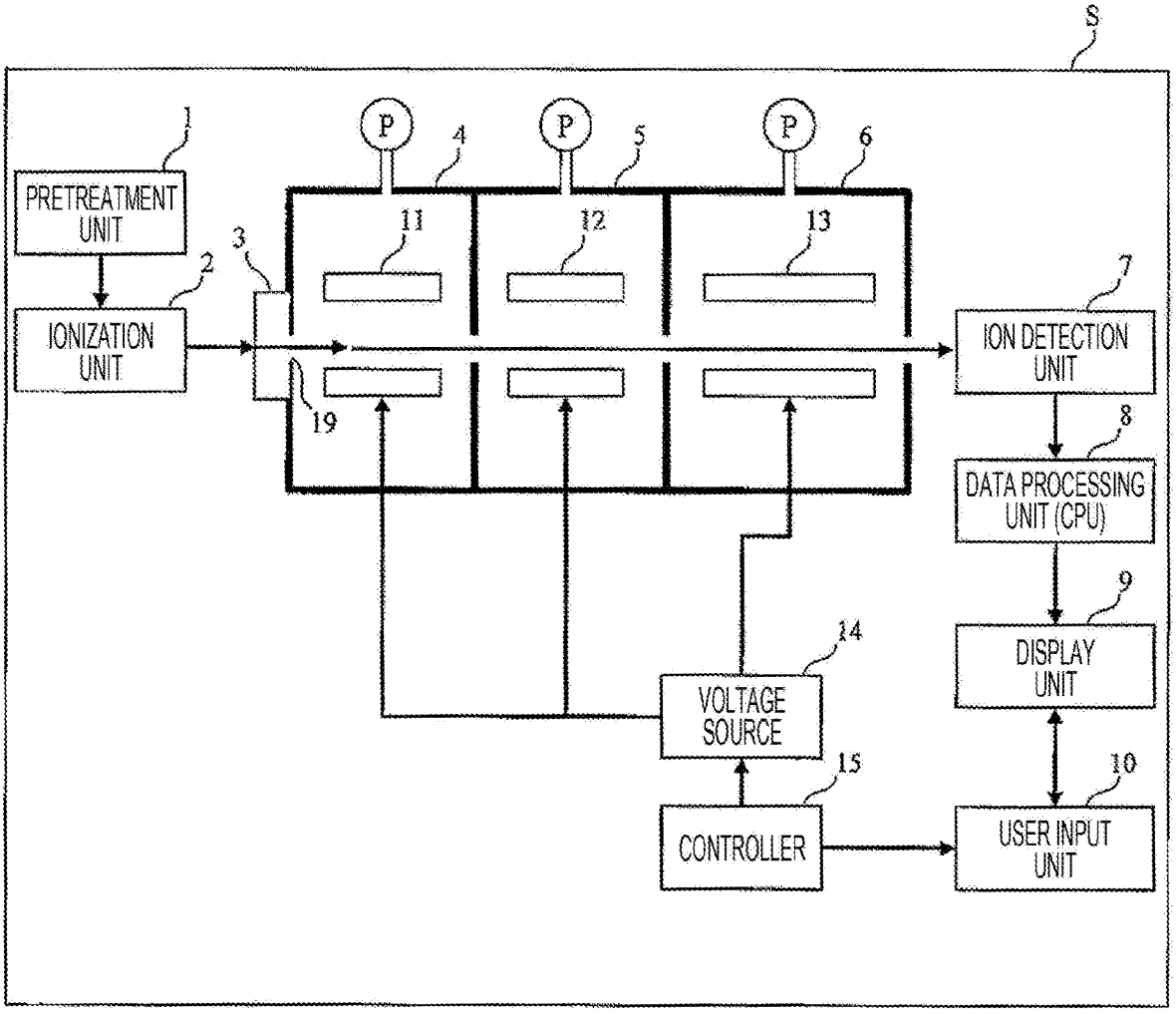
FIG. 2 is a schematic diagram of a configuration of a mass spectrometer according to an embodiment.

FIG. 2 is a schematic diagram of a configuration of a mass spectrometer S according to an embodiment. In this specification, the mass spectrometer S of the embodiment will be described by taking a triple quadrupole mass spectrometer as an example. The mass spectrometer S includes a pretreatment unit 1, an ionization unit 2, a nozzle unit 3, a vacuum chamber 4, a collision chamber 5, a mass analysis unit 6, an ion detection unit 7, a data processing unit 8, a display unit 9, and a user input unit 10. Further, the vacuum chamber 4, the collision chamber 5 and the mass analysis unit 6 are each connected to a pump P which is an exhaust means, and include quadrupole electrodes 11, 12, and 13 in the room, respectively. The mass spectrometer S includes a voltage source 14 that applies a voltage to the electrodes 11, 12, and 13, and a controller 15 that controls the voltage.

The pretreatment unit 1 is, for example, a gas chromatography (GC) or a liquid chromatography (LC), which separates or fractionates the sample for mass spectrometry in terms of time. The ionization unit 2 sequentially ionizes the sample flowing from the pretreatment unit 1. Note that the ionized sample is in a gaseous or gas phase.

The nozzle unit 3 is connected to the ionization unit 2 by a flow pipe (not shown), and has an inflow port into which the ionized sample flows and an outflow port from which the inflowing sample flows out. The outflow port is coincident with one of the openings provided in the vacuum chamber 4. Further, a division portion that extends from an inflow port 3*a* to an outflow port 3*b* and divides the flow of the sample is provided inside the nozzle unit 3. Due to the presence of the division portion, the flow of the sample is divided into a plurality of flows in the nozzle unit 3. The nozzle unit 3 is made of a metal material such as SUS, for example.

The vacuum chamber 4 is evacuated by the pump P and includes the quadrupole electrode 11 as described above. As the pump P, for example, a rotary pump or a turbo molecular pump is used. An AC voltage is applied to the electrode 11, and ions (precursor ions) having a specific range of mass-to-charge ratio (m/Z ratio) of the sample flowing into the vacuum chamber 4 from the nozzle unit 3 pass through the vacuum chamber 4. Here, m is the ion mass, and Z is the charge valence of the ion. The vacuum chamber 4 functions as an ion guide, for example.

Here, the pressure upstream of the flow pipe connected to the inflow port of the nozzle unit 3 is approximately the same as the atmospheric pressure, and the pressure in the vacuum chamber 4 is approximately several pascals. Specifically, the ratio P1/P2 between the pressure P1 in the flow pipe and the pressure P2 in the vacuum chamber 4 is, for example, 50 times or more. As the sample moves between the chambers with the above pressure difference, an expansion wave is generated.

The collision chamber 5 is evacuated by the pump P and then filled with an inert gas such as helium or argon. Precursor ions that have passed through the vacuum chamber 4 collide with helium and argon, and their chemical bonds are broken and they are split into fragment ions. As described above, the collision chamber 5 is provided with the electrodes 12, and the fragment ions are accelerated and transported to the mass analysis unit 6 by applying a voltage to the electrodes 12.

The mass analysis unit 6 is evacuated by the pump P and is in a high vacuum state. The mass analysis unit 6 is in a vacuum state of the order of about mPa, for example. The mass analysis unit 6 includes the quadrupole electrodes 13. Ions with the m/Z ratio in a specific range out of fragment ions are selected by applying a DC voltage U and an AC voltage $V_{RF}COS\ (\Omega_{RF}t+RF)$ to the electrodes 13.

The ion detection unit 7 detects the composition ratio, mass, and the like of the ions selected by the mass analysis unit 6. The ion detection unit 7 notifies the data processing unit 8 of the acquired data. The data processing unit 8 analyzes the data acquired from the ion detection unit 7. The data processing unit 8 identifies ions before fragmentation occurs, for example, by collating with a previously recorded database. The data processing unit 8 displays the analysis result on the display unit 9.

The display unit 9 displays the mass spectrometry data acquired from the data processing unit 8. For example, the names of substances contained in the sample and their mass ratios are displayed as mass spectrometry data on the display unit 9. Further, the display unit 9 displays various setting items of the mass spectrometer S input by the user via the user input unit 10. The user input unit 10 receives input from the user. The user inputs, for example, voltages to be applied to the quadrupole electrodes 11 to 13 included in the vacuum chamber 4, the collision chamber 5, and the mass analysis unit 6 to the user input unit 10. The voltage source 14 applies a voltage having a value set by the user to the electrodes 11 to 13. In addition, the user input unit 10 receives input related to the chamber pressures of the vacuum chamber 4, the collision chamber 5, and the mass analysis unit 6. The mass spectrometer S of the embodiment is capable of changing the pressure in each chamber.

A controller 8 controls ionization of the sample, transport or incidence of the sample ion beam into the mass analysis unit 6, mass separation, ion detection, data processing, input processing received by the user input unit 10, and the like.

[Method of Ion Selection]

Next, a method of selecting specific ions from the ionized sample by the mass spectrometer S will be described.

Figure 3:
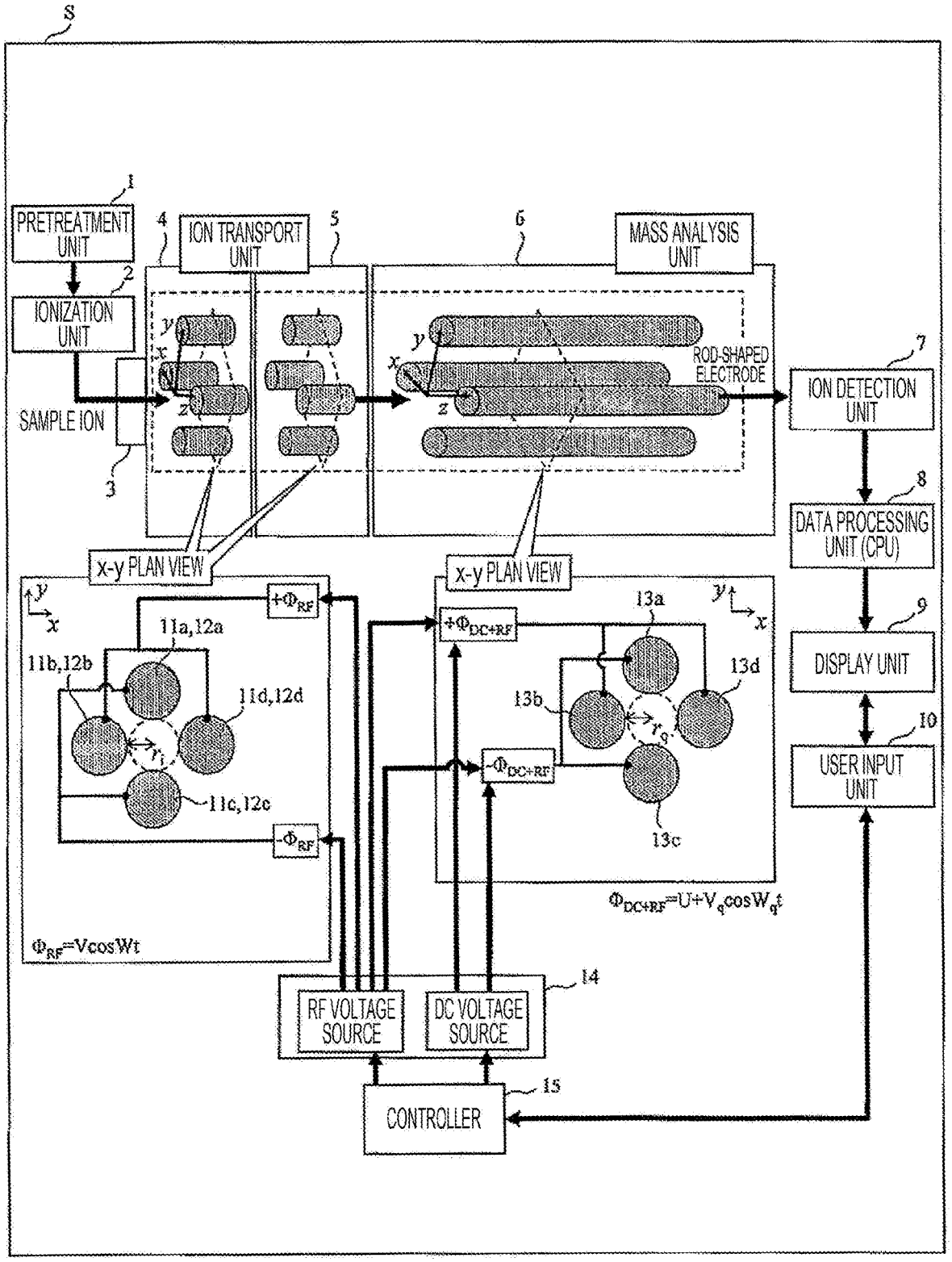
FIG. 3 is a diagram showing a stable ion transmission region in a quadrupole electric field.

FIG. 3 is a diagram showing in detail the electrodes 11, 12, and 13 provided in the mass spectrometer S. In FIG. 3, as an example, a quadrupole mass spectrometer (QMS) is shown in which each of the electrodes 11, 12, and 13 is composed of four rod-shaped electrodes. In addition to the QMS, the electrode configuration may be a multipole mass spectrometer including four or more rod-shaped electrodes. Further, the four rod-shaped electrodes may be cylindrical electrodes, or may be electrodes in which the opposing surfaces of a set of electrodes have a bipolar surface shape.

As shown in FIG. 3, for example, only an AC voltage is applied to the electrodes provided in the vacuum chamber 4 and the collision chamber 5. In particular, the AC voltage $+\Phi_{RF}$=VCOSWt is applied to one set of electrodes of the two sets of electrodes, and the $-\Phi_{RF}$=−VCOSWt, which is the reverse phase of the AC voltage, is applied to the other set of electrodes. Here, as shown in FIG. 3, the two electrodes in a pair face each other. The electric field generated by the application of the voltage vibrates charged ions, but does not act on neutral particles. Accordingly, the charged ions pass through the vacuum chamber 4 and the collision chamber 5, while the neutral particles hardly pass through the chamber.

On the other hand, for example, both a DC voltage and an AC voltage are applied to the electrodes included in the mass analysis unit 6. In particular, the sum of DC voltage and AC voltage $+\Phi_{DC+RF}$=U+$V_q$COS$W_q$t is applied to one set of electrodes of the two sets of electrodes, and the $-\Phi_{DC+RF}$=−U−$V_q$COS$W_q$t, which is the reverse phase of the voltage, is applied to the other set of electrodes. Here, as shown in FIG. 3, the two electrodes in a pair face each other. The electric field generated by the application of the voltage allows ions having an m/Z ratio in a specific range or with a specific value to pass therethrough, but does not allow ions other than the above ions to pass therethrough.

The mechanism by which the mass analysis unit 6 selects ions will be described in more detail with reference to FIGS. 4 and 5. The radio frequency electric field Ex and Ey represented by the following equations is generated between the four rod-shaped electrodes to which the voltage is applied.

[Math 1]

$$E_x = -\frac{\partial \Phi_{main}}{\partial x} = -\frac{2(U + V_{RF}\cos(\Omega_{RF}t + \varphi_{RF}))}{r_0^2} \cdot x \quad (1)$$

$$E_y = -\frac{\partial \Phi_{main}}{\partial y} = -\frac{2(U + V_{RF}\cos(\Omega_{RF}t + \varphi_{RF}))}{r_0^2} \cdot y$$

The ionized sample is introduced along the central axis (the z-axis direction in the figure) between the electrodes included in the mass analysis unit 6, and passes through the radio frequency electric field represented by Equation (1). The stability of the orbit of ions in the radio frequency electric field in the x-axis direction and the y-axis direction is determined by the following dimensionless parameters a and q derived from the ion motion equation (Mathieu equation).

[Math 2]

$$a = \frac{8eZU}{\Omega_{RF}^2 m r_0^2} \quad (2)$$

$$q = \frac{4eZV_{RF}}{\Omega_{RF}^2 m r_0^2} \quad (3)$$

where the dimensionless parameters a and q are stability parameters in the QMS. In Equations (2) and (3), $r_0$ is half the distance between the opposing electrodes, e is elementary charge, m/Z is the mass-to-charge ratio of ions, U is the DC voltage applied to the electrodes 13, $V_{RF}$ is the amplitude of the radio frequency voltage, and $\Omega_{RF}$ is the angular vibration frequency. Once the values of $r_0$, U, $V_{RF}$, and $\Omega_{RF}$ are determined, each ion species corresponds to a different (a, q) point on the a-q plane, depending on its mass-to-charge ratio m/Z. A group of sets of DC voltage and AC voltage values for the ion species to pass through the mass analysis unit 6 and be detected by the ion detection unit 7 forms a region on the a-q plane. The region is referred to as a stable region.

Figure 4A:
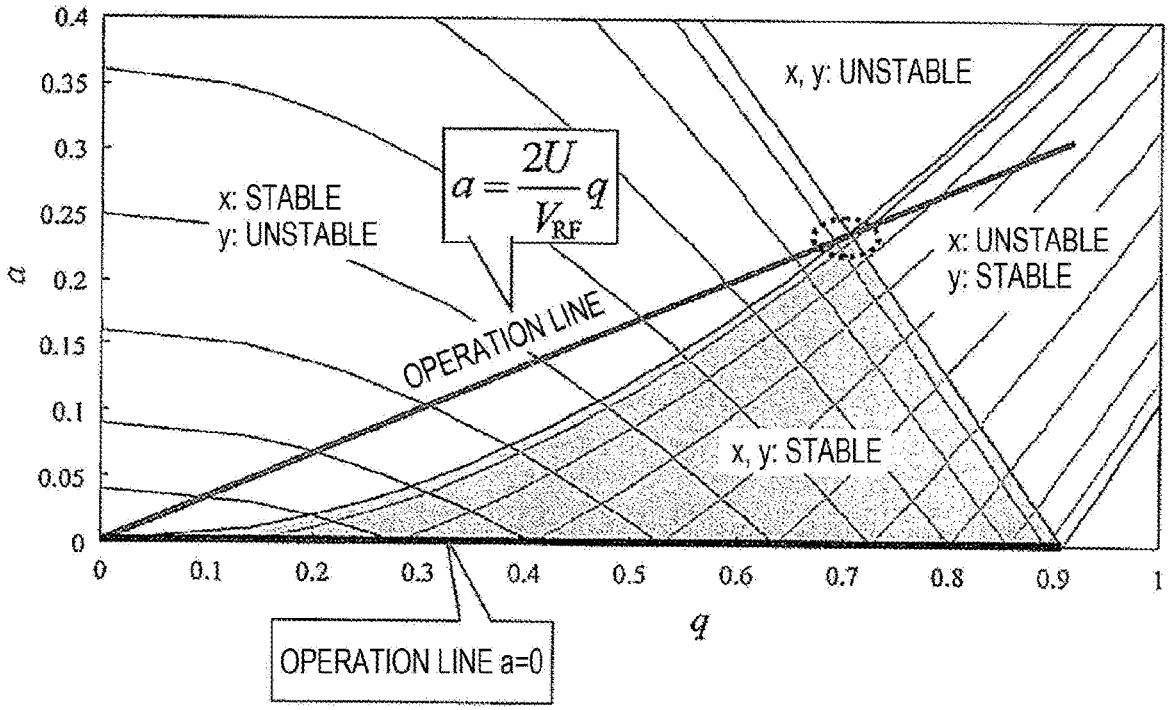
FIGS. 4A and 4B are diagrams showing an a-q plane.
Figure 4B:
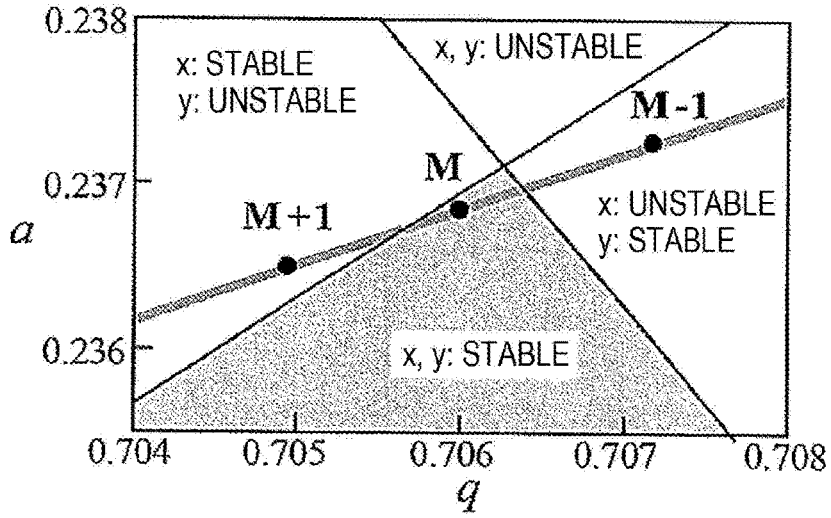

FIG. 4 is a diagram showing the a-q plane. FIG. 4(*a*) is a diagram showing the entire a-q plane, and FIG. 4(*b*) is an enlarged view of the vicinity of the boundary points of four regions in the a-q plane. In FIGS. 4(*a*) and 4(*b*), the shaded portion is the stable region. The straight line shown in FIG. 4(*a*) is a straight line indicated by the following Equation 4 derived from Equations (2) and (3).

[Math 3]

$$a = \frac{2U}{V_{RF}} \cdot q \quad (4)$$

As can be seen from Equation (4), the slope of the straight line changes by changing the DC voltage U and the amplitude $V_{RF}$ of the AC voltage. An increase in the DC voltage value U increases the slope of the straight line, and the straight line does not intersect the stable region. That is, as the DC voltage U increases, ions cannot pass through the mass analysis unit 6. Further, the greater the AC voltage amplitude $V_{RF}$, the smaller the slope of the straight line, and the straight line intersects the stable region. That is, the larger the amplitude $V_{RF}$ of the AC voltage, the easier the ions pass through the mass analysis unit 6.

Here, as shown in Equations (2) and (3), when the applied voltage is fixed, the points (a, q) have a one-to-one correspondence with the mass-to-charge ratios. Therefore, if the portion of the straight line that intersects the stable region is short, fewer ionic species pass through the mass analysis unit 6. In particular, when the voltages U and $V_{RF}$ are set so that the straight line passes through the boundary point between the stable region and the unstable region, only one type of ion can pass through the mass analysis unit 6.

In particular, some ions pass through the mass analysis unit 6 while vibrating between the electrodes 13*a*, 13*b*, 13*c*, and 13*d*, while some other ions have diverging vibration, and are emitted in the x-axis direction or the y-axis direction shown in FIG. 3. Thus, the mass spectrometer S can change the ions to be detected by adjusting the voltage to be applied.

Figure 5:
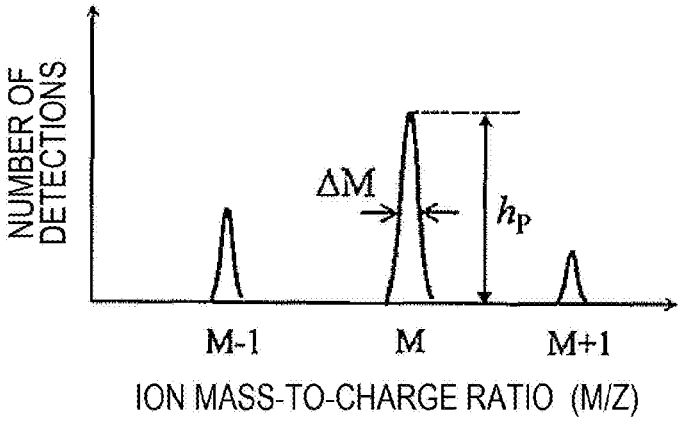
FIG. 5 is spectral data showing the number of detections for each ion species.

FIG. 5 is spectral data indicating the number of detections for each ion species. The ion species M−1, M, and M+1 shown in FIG. 5 correspond to M−1, M, and M+1 shown on the straight line in FIG. 4(*b*), respectively. As shown in FIG. 5, ions M which are points on the stable region are detected in a larger number than ions M−1 and M+1 located on the unstable region.

[Nozzle Unit Shape]

Subsequently, the shape of the nozzle unit 3 provided in the mass spectrometer S of the embodiment will be described.

Figure 6:
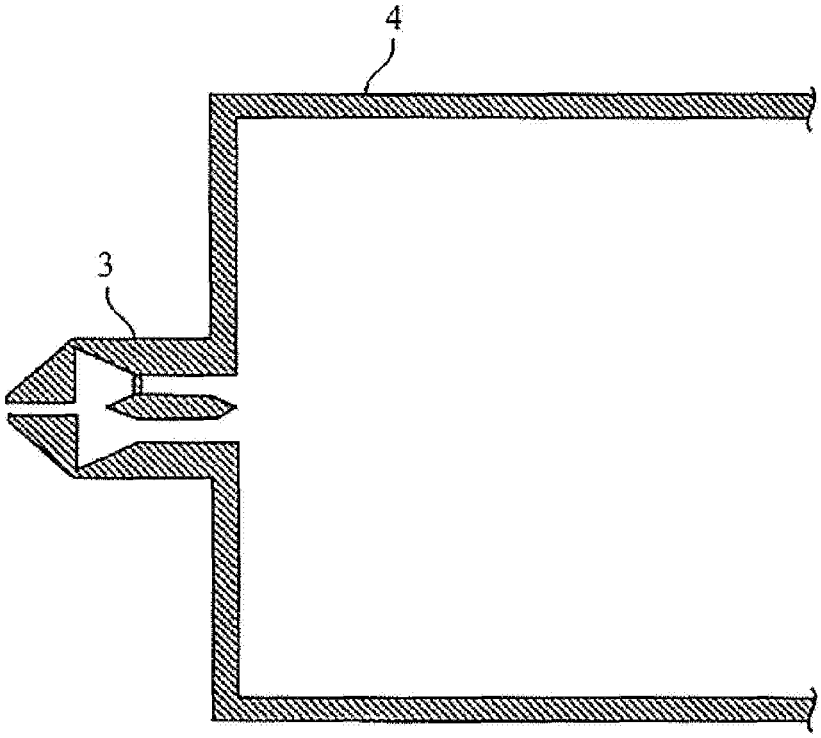
FIG. 6 is a cross-sectional view of a nozzle unit and a vacuum chamber.

FIG. 6 is a cross-sectional view of the nozzle unit 3 and the vacuum chamber 4. In FIG. 6, the nozzle unit 3 and the vacuum chamber 4 are integrally formed, but the nozzle unit 3 may be detachable from the vacuum chamber 4.

Figure 7A:
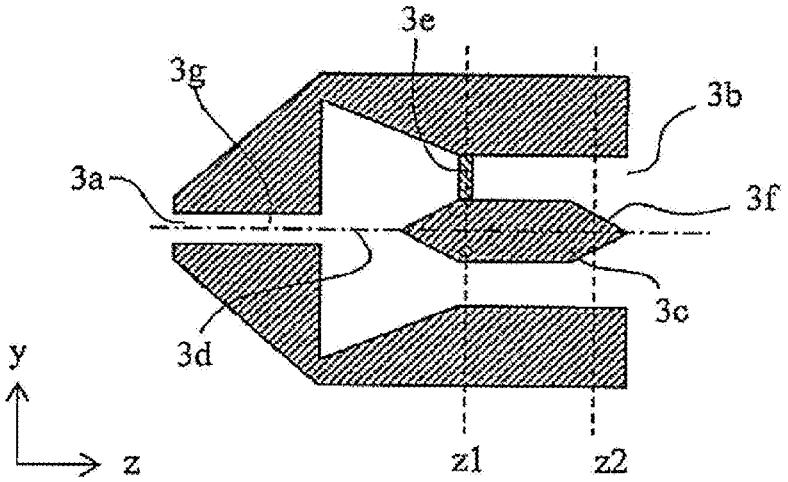
FIGS. 7A to 7C are cross-sectional views of a nozzle unit.
Figure 7B:
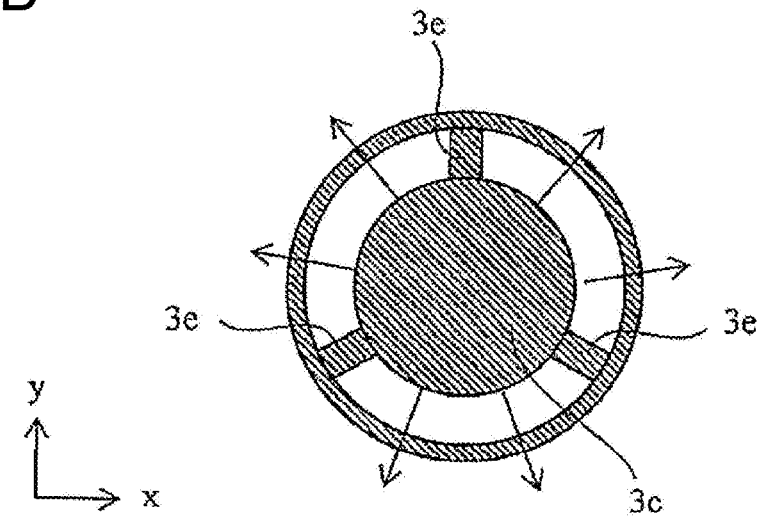
Figure 7C:
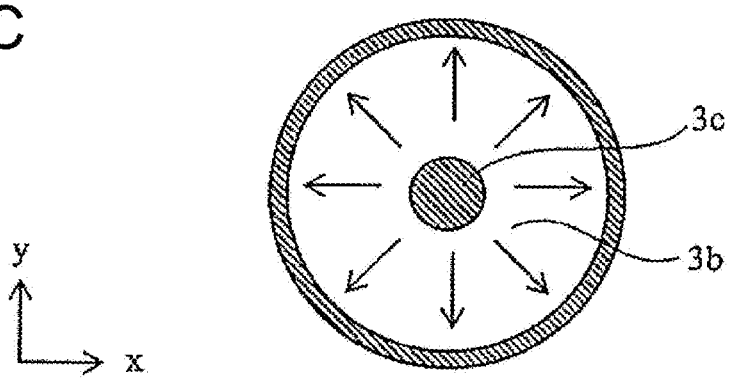

FIG. 7 is a cross-sectional view of the nozzle unit 3. FIG. 7(*a*) is a cross-sectional view of the nozzle unit 3 when cut along the yz plane shown in FIG. 3. FIG. 7(*b*) is a cross-sectional view of the nozzle unit 3 cut along the xy plane at the position z1 shown in FIG. 7(*a*). FIG. 7(*c*) is a cross-sectional view when the nozzle unit 3 is cut along the xy plane at the position z2 shown in FIG. 7(*a*). The arrows shown in FIGS. 7(*a*) and 7(*b*) indicate how the sample expands in the direction of the xy plane when it flows into the vacuum chamber 4.

As shown in FIG. 7(*a*), the inside of the nozzle unit 3 is configured such that the central axes of the inflow port 3*a*, the outflow port 3*b*, and a division portion 3*c* are along an identical straight line 3*d*. Further, the division portion 3*c* is supported by support portions 3*e* connected to the inner wall of the nozzle unit 3.

The division portion 3*c* has a tapered projection 3*f* whose diameter decreases as it goes downstream of the flow of the sample. In other words, the division portion 3*c* has the projection 3*f* whose diameter decreases from the inflow port 3*a* toward the outflow port 3*b*. FIG. 7(*a*) shows the projection 3*f* having a conical shape as the above projection 3*f*, for example. Therefore, the division portion 3*c* has a substantially circular cross section.

Further, as shown in FIGS. 7(*a*) and 7(*b*), the division portion 3*c* is supported by a plurality of support portions 3*e*, and the support portions 3*e* are provided on the inner wall of the nozzle unit 3 at a position closer to the inflow port 3*a* than the outflow port 3*b*. The division portion 3*c* may be supported by one support portion 3*e*. In addition, since the central axis of the projection 3*f* coincides with the central axis of the division portion 3*c*, it substantially coincides with the central axis of the outflow port 3*b*.

As shown in FIG. 7(*b*), after the flow of the sample that has passed through the inflow port 3*a* passes through a flow passage 3*g* on the central axis, it is divided into a plurality of flows due to the presence of the division portion 3*c* and the support portions 3*e*. As shown in FIG. 7(*c*), the vicinity of the outflow port 3*b* has an annular shape due to the presence of the division portion 3*c*. Therefore, the fluid of the sample is ejected into the vacuum chamber 4 in a state where it is spatially away or separated without converging into one. The spatially separated fluid easily flows toward the central axis 3*d* and crosses each other due to the presence of the conical projection 3*f* included in the division portions 3*c*.

Further, since the cross section of the division portion 3*c* is substantially circular, and the divided sample reaches the outflow port through the passage with almost the same pressure, each of the expansion wave and the reflected wave of the divided fluid preferably cancel each other. In order to cancel out the expansion wave and its reflected wave well, the divided sample fluid preferably passes through the passage with the same pressure and the same length to reach the outflow port. Therefore, for example, the design is made such that the central axes of the inflow port 3*a*, the outflow port 3*b*, and the division portion 3*c* coincide with each other.

Figure 8B:
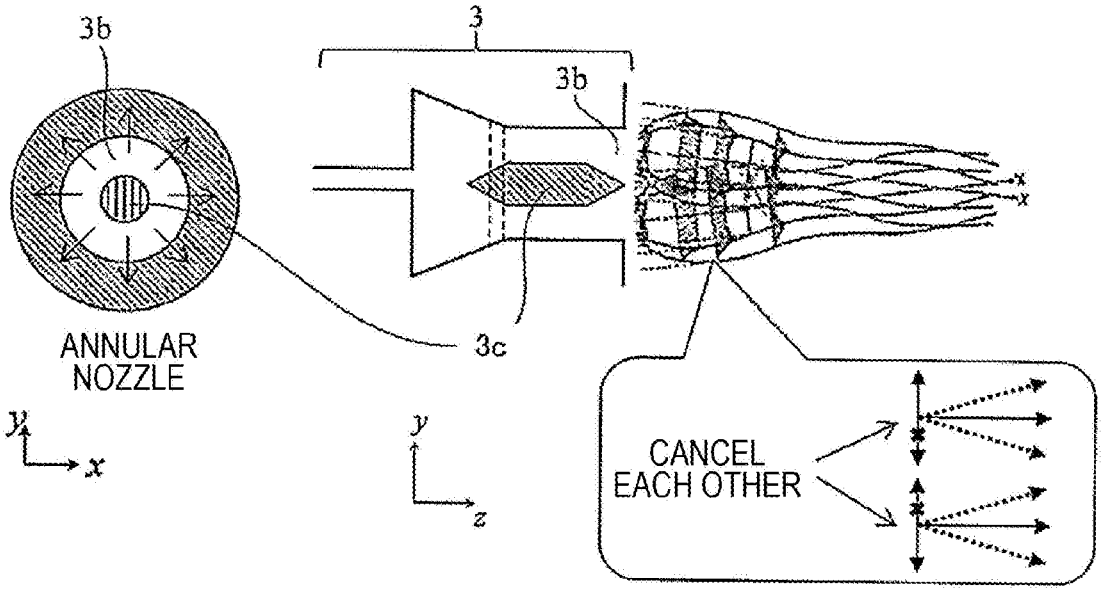

FIG. 8 is a diagram comparing the flows of the sample. FIG. 8 (*a*) is a diagram showing the flow of the sample when a conventional nozzle unit is used. FIG. 8(*b*) is a diagram showing the flow of the sample when the nozzle unit 3 of the embodiment is used.

In a conventional nozzle unit 16, no division portion is provided inside. Therefore, the sample flows out from an outflow port 16*b* of the nozzle unit 16 as single converged fluid, and an expansion wave is formed in the vacuum chamber. On the other hand, the sample that passes through the nozzle unit 3 according to the embodiment flows out from the outflow port 3*b* after the flow is divided by the division portion 3*c*, and a plurality of expansion waves is formed in the vacuum chamber 4. The plurality of expansion waves and/or their reflected waves interfere with each other and cancel components in the y-axis direction. As a result, the expansion waves reflected on the boundary of the jet are reduced.

Figure 9A:
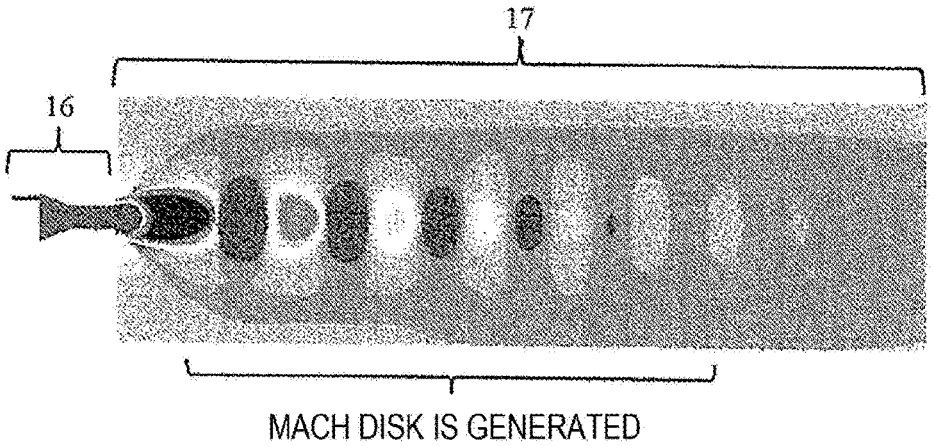
FIGS. 9A and 9B are diagrams showing the result of numerical analysis of the sample flow.
Figure 9B:
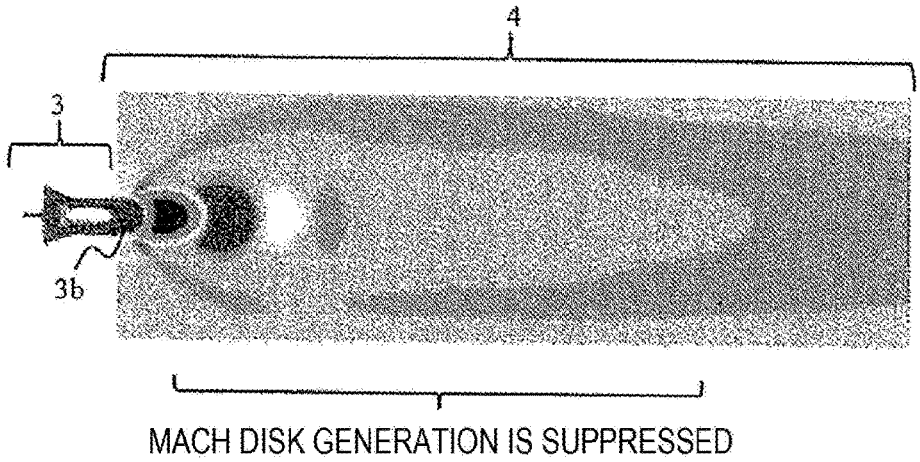

FIG. 9 is a diagram showing the result of numerical analysis of the sample flow. FIG. 9(*a*) is a diagram showing the flow of the sample when the conventional nozzle unit 16 is used. FIG. 9(*b*) is a diagram showing the flow of the sample when the nozzle unit 3 of this embodiment is used. Here, the pressure distribution is expressed in shades, and the darker the shade is, the higher the pressure is.

In the case where the conventional nozzle unit 16 is used, the jet of the sample flowing into the vacuum chamber 17 shows the region where the pressure is periodically high and low. The region where the pressure is high is a region where the Mach disk is formed. The formation of such a Mach disk deteriorates the sensitivity of mass spectrometry.

On the other hand, when the nozzle unit 3 according to the embodiment is used, the periodic distribution of the pressure hardly appears in the jet of the sample flowing into the vacuum chamber 4. That is, it can be seen that when the nozzle unit 3 according to the embodiment is used, generation of the Mach disk is considerably suppressed.

As explained with reference to FIG. 8(*b*), it is presumed that the reason why generation of the Mach disk is suppressed is that the fluid of the sample is divided inside the nozzle unit 3, and flows out from the outflow port 3*b* in a direction crossing each other. The suppression mechanism of the Mach disk does not depend on the shape of the jet. Therefore, the mass spectrometer S of the embodiment can suppress generation of the Mach disk even if the pressure upstream of the nozzle unit 3 and the pressure in the vacuum chamber 4 are changed. That is, the mass spectrometer S of the embodiment can suppress generation of the Mach disk over a wide range of operating conditions. Suppressing Mach disk formation results in improved sensitivity and stabilization of mass spectrometry.

<Modification 1>

Figure 10A:
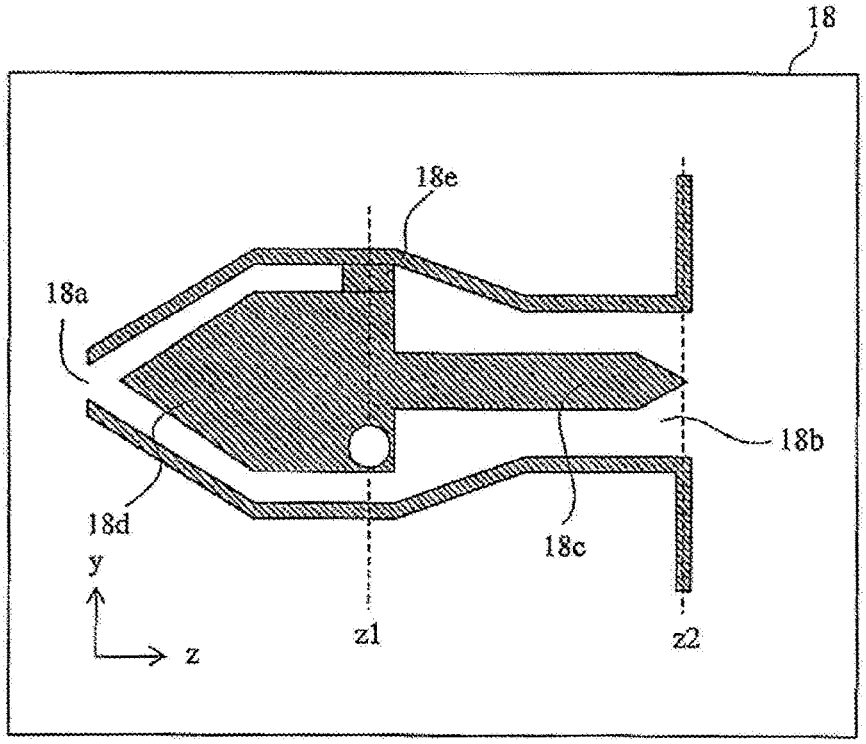
FIGS. 10A to 10C are cross-sectional views of a nozzle unit of Modification 1.
Figure 10B:
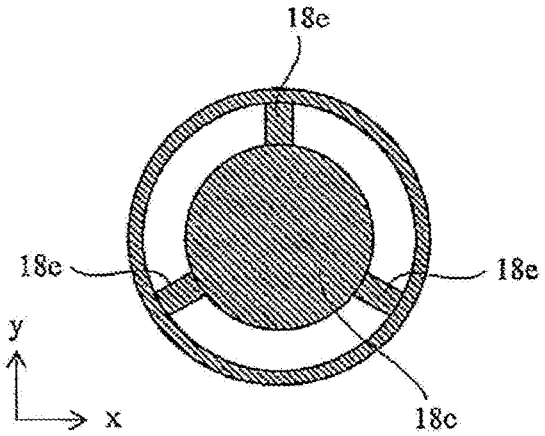
Figure 10C:
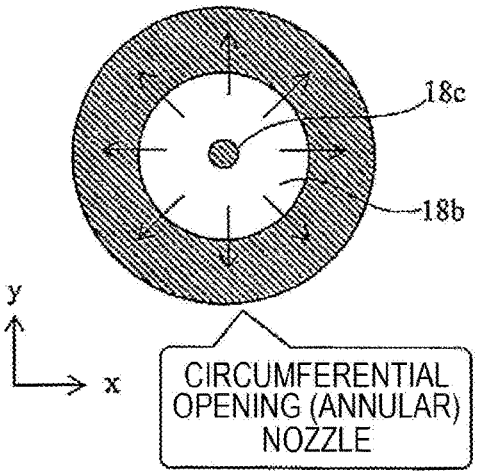

FIG. 10 is a cross-sectional view of a nozzle unit 18 of Modification 1. FIG. 10(*a*) is a cross-sectional view of the nozzle unit 18 when cut along the yz plane shown in FIG. 3. FIG. 10(*b*) is a cross-sectional view of the nozzle unit 18 when cut along the xy plane at the position z1 shown in FIG. 10(*a*). FIG. 10(*c*) is a cross-sectional view of the nozzle unit 18 when cut along the xy plane at the position z2 shown in FIG. 10 (*a*).

In the nozzle unit 3 of the embodiment, after the sample flowed into the nozzle unit 3 from the inflow port 3*a*, it reached the division portion 3*c* through the trapezoidal space and divided. On the other hand, the nozzle unit 18 of Modification 1 is configured such that the sample is divided immediately after it flows into an inflow port 18*a*. Specifically, the nozzle unit 18 includes a division portion 18*c* having a projection 18*d* whose tip is located toward an inflow port 18*a*.

In this way, the sample becomes a gas flow divided by the division portion 18*c* immediately after passing through the inflow port 18*a*. Accordingly, the gas flow is easily dispersed uniformly around the division portion 18*c*. As a result, the components of the expansion wave and its reflected wave in the xy direction are canceled well immediately after the sample flows into the vacuum chamber 4. That is, generation of the Mach disk is suppressed.

Further, in the nozzle unit 18 provided with the division portion 18*c*, a support portion 18*e* for fixing the division portion 18*c* can be designed to be long in the z-axis direction, so that the division portion 18*c* can be supported more firmly, compared with that of the nozzle unit 3 according to the embodiment. A projection 18*d* of the division portion 18*c* may protrude outward of the nozzle unit 18 relative to the inflow port 18*a*.

Figure 11:
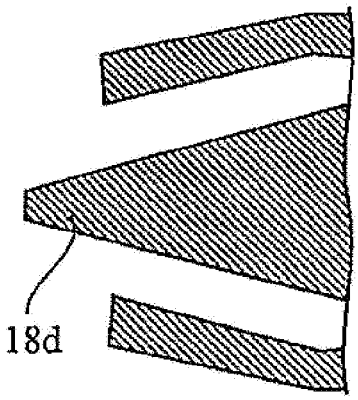
FIG. 11 is a diagram showing a state in which the projection of the division portion protrudes from the inflow port.

FIG. 11 is a diagram illustrating a state in which the projection 18*d* of the division portion 18 protrudes relative to the inflow port 18*a*. Since the sample fluid collides with the projection 18*d* of the division portion 18*c*, dirt easily adheres. The dirt reduces the sensitivity of mass spectrometry because it is removed from the division portion 18*c*, so that the nozzle unit 18 needs to be periodically cleaned. In the example shown in FIG. 11, the projection 18*d* is easy to clean and the maintainability is improved. As a result, errors are less likely to occur in the analysis data of mass spectrometry.

<Modification 2>

Figure 12A:
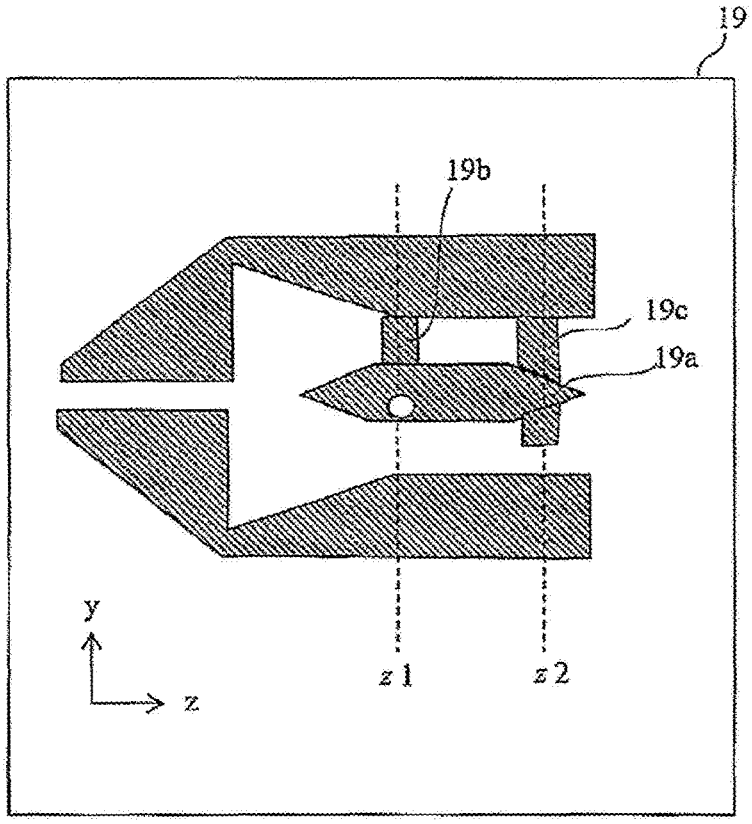
FIGS. 12A to 12C are cross-sectional views of a nozzle unit of Modification 2.
Figure 12B:
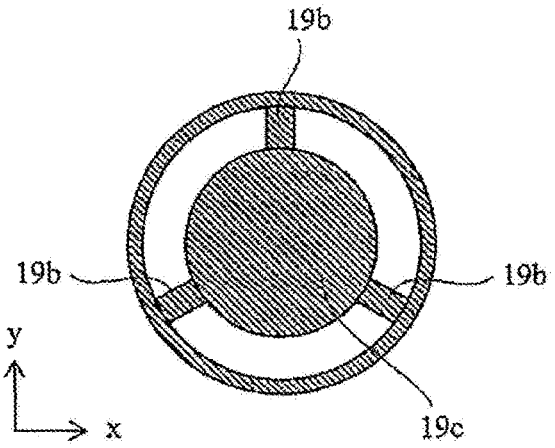
Figure 12C:
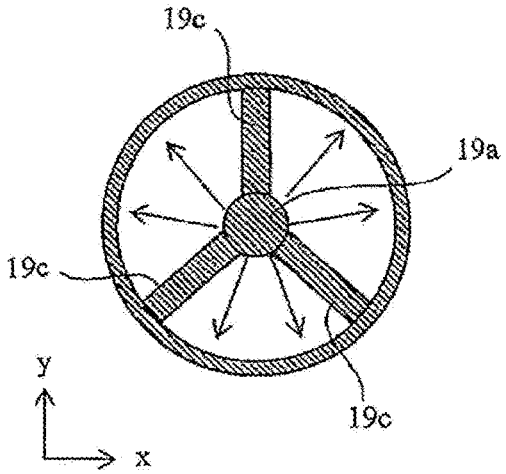

FIG. 12 is a cross-sectional view of a nozzle unit 19 of Modification 2. FIG. 12(*a*) is a cross-sectional view of the nozzle unit 19 when cut along the yz plane shown in FIG. 3. FIG. 12(*b*) is a cross-sectional view of the nozzle unit 19 when cut along the xy plane at the position z1 shown in FIG. 12(*a*). FIG. 12(*c*) is a cross-sectional view of the nozzle unit 19 when cut along the xy plane at the position z2 shown in FIG. 12 (*a*).

In the nozzle unit 3 of the embodiment, the division portion 3*c* is supported at one position in the z-axis direction. On the other hand, the nozzle unit 19 of Modification 2 supports a division portion 19*a* at two positions in the direction in which the sample flows. In FIG. 12(*a*), the division portion 19*a* is supported by support portions 19*b* and 19*c* provided at z1 and z2. In this way, the division portion 19*a* can be fixed more firmly than that of the nozzle unit 3 according to the embodiment.

As shown in FIGS. 12(*b*) and (*c*), the division portion 19*a* is preferably supported from a plurality of directions at each of z1 and z2. Thus, unlike the case where the division portion is supported from one direction, the division portion 19*a* can be supported more firmly.

<Modification 3>

Figure 13A:
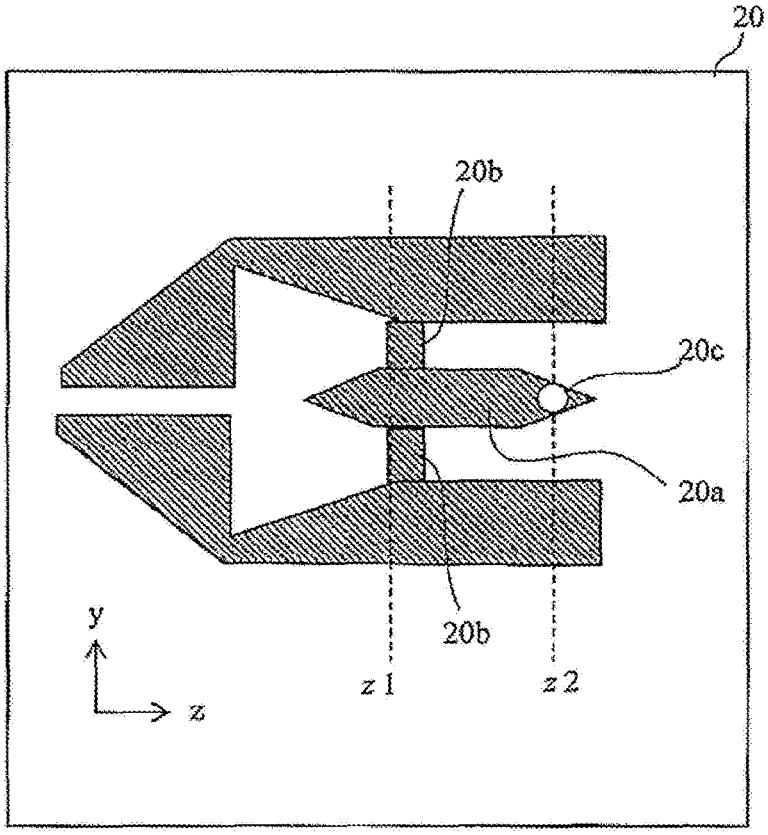
FIGS. 13A to 13C are cross-sectional views of a nozzle unit of Modification 3.
Figure 13B:
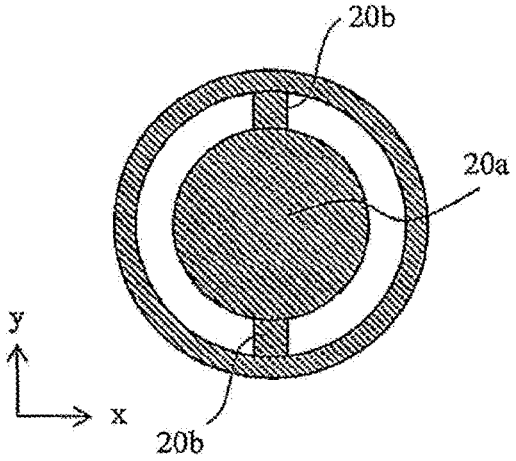
Figure 13C:
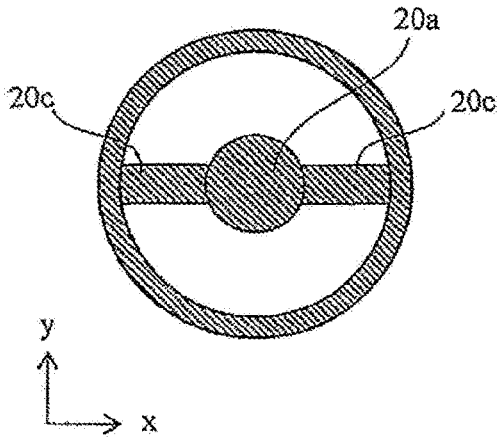

FIG. 13 is a cross-sectional view of a nozzle unit 20 of Modification 3. FIG. 13(*a*) is a cross-sectional view of the nozzle unit 20 when cut along the yz plane shown in FIG. 3. FIG. 13(*b*) is a cross-sectional view of the nozzle unit 20 when cut along the xy plane at the position z1 shown in FIG. 13(*a*). FIG. 13(*c*) is a cross-sectional view of the nozzle unit 20 when cut along the xy plane at the position z2 shown in FIG. 13 (*a*).

As shown in FIG. 13, the nozzle unit 20 of Modification 3 supports a division portion 20*a* from different directions at two positions in the direction in which the sample flows. As shown in FIGS. 13(*b*) and (*c*), the division portion 20*a* is supported by a support portion 20*b* from the direction parallel to the y-axis direction at the position of z1, and it is supported by a support portion 20*c* from the direction parallel to the x-axis direction at the position z2. In this way, the fluid of the sample is divided into a plurality, and when the sample flows into the vacuum chamber 4, the expansion wave and the reflected wave easily interfere with each other.

<Modification 4>

Figure 14:
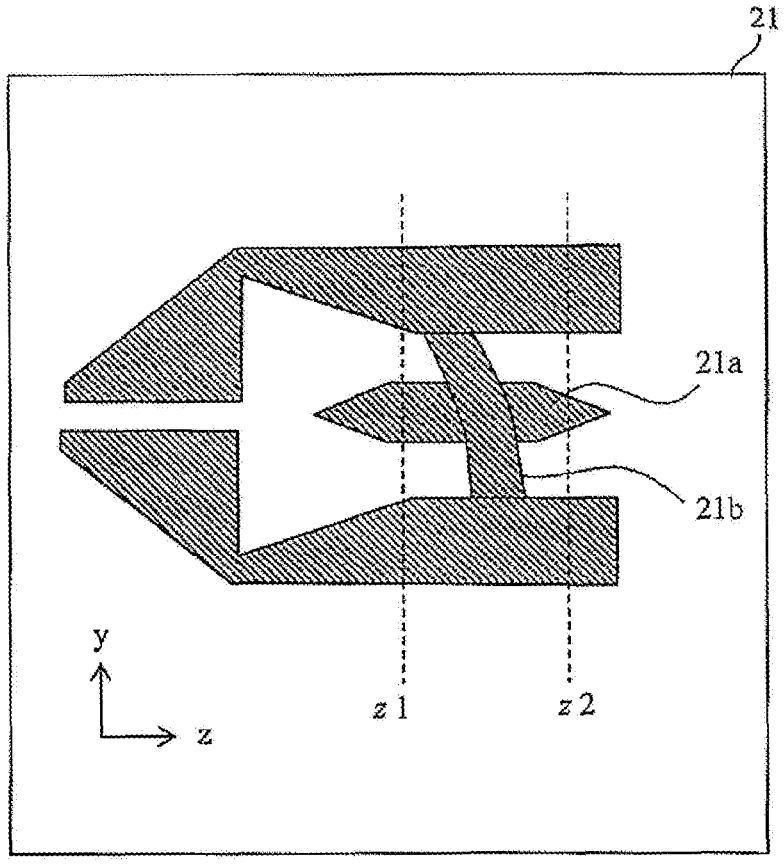
FIG. 14 is a cross-sectional view of a nozzle unit of Modification 4.

FIG. 14 is a cross-sectional view of a nozzle unit 21 of Modification 4. As shown in FIG. 14, a division portion 21*a* of the nozzle unit 21 is supported by a spiral support portion 21*b*. In this case, since the sample flows into the vacuum chamber 4 while rotating in the xy plane, the expansion waves easily cross each other, and the Mach disk is satisfactorily suppressed. Further, since the contact area between the division portion 21*a*, the support portion 21*b*, and the inner wall inside the nozzle is increased, the division portion 21*a* is firmly supported.

<Modification 5>

Figure 15A:
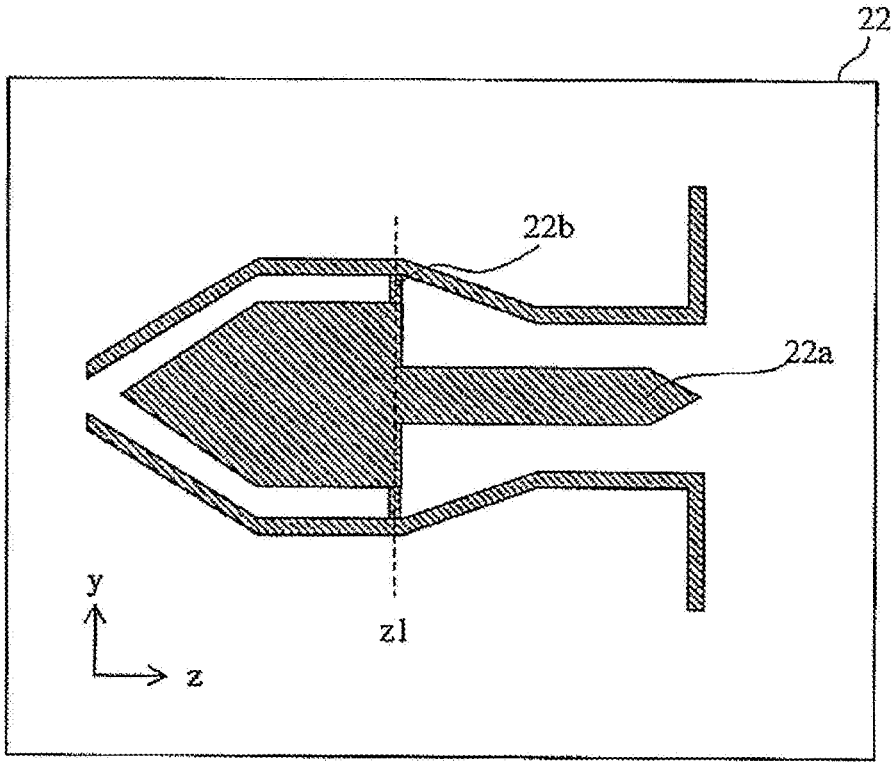
FIGS. 15A and 15B cross-sectional views of a nozzle unit of Modification 5.
Figure 15B:
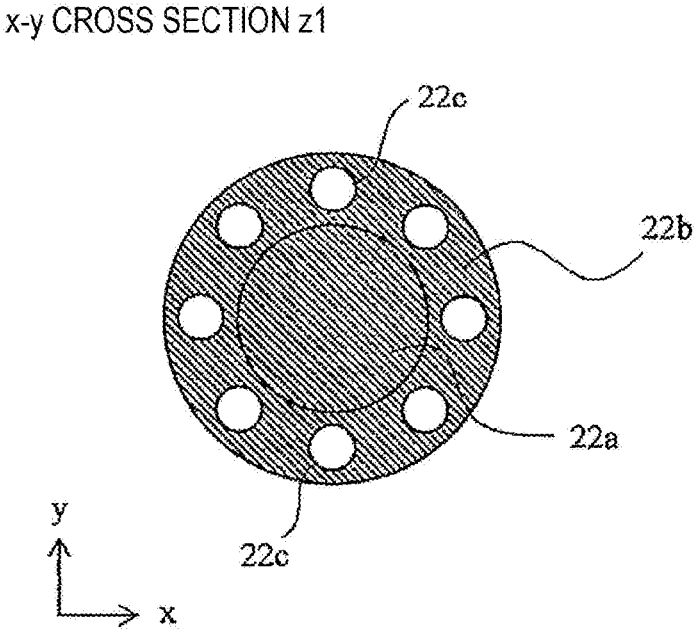

FIG. 15 is a cross-sectional view of a nozzle unit 22 of Modification 5. FIG. 15(*a*) is a cross-sectional view of the nozzle unit 22 when cut along the yz plane shown in FIG. 3. FIG. 15(*b*) is a cross-sectional view of the nozzle unit 22 when cut along the xy plane at the position z1 shown in FIG. 15 (*a*).

In Modification 5, a division portion 22*a* is supported by an annular support portion 22*b* that has a boundary with the outer periphery of the division portion 22*a* and the outer periphery of the inner wall of the nozzle unit 22, where the annular support portion 22*b* is provided with a plurality of holes 22*c*. When the support portion 22*b* is used, the sample passes through the plurality of holes 22*c*. Therefore, the plurality of fluids crosses to easily suppress the Mach disk. Further, since the contact area between the division portion 22*a*, the support portion 22*b*, and the inner wall inside the nozzle is increased, the division portion 22*a* is firmly supported.

<Modification 6>

Figure 16A:
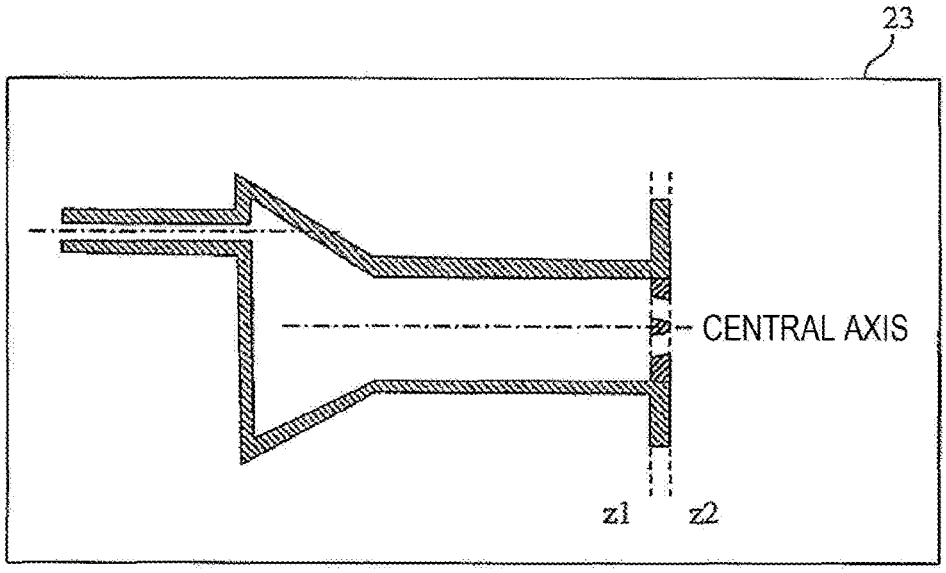
FIGS. 16A to 16C cross-sectional views of a nozzle unit of Modification 6.
Figure 16B:
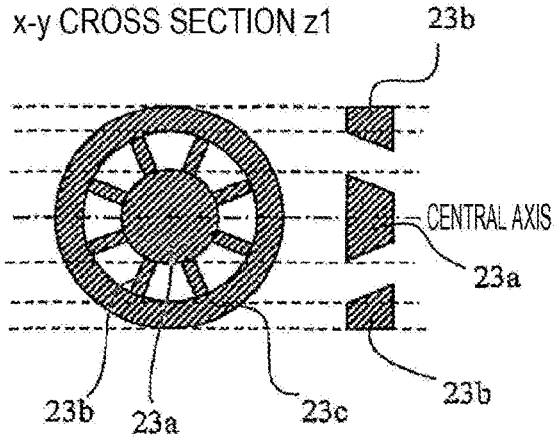
Figure 16C:
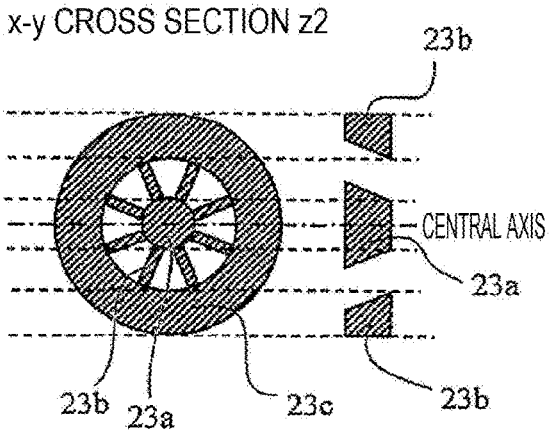

FIG. 16 is a cross-sectional view of a nozzle unit 23 of Modification 6. FIG. 16(*a*) is a cross-sectional view of the nozzle unit 23 when cut along the yz plane shown in FIG. 3. FIG. 16(*b*) is a cross-sectional view of the nozzle unit 23 when cut along the xy plane at the position z1 shown in FIG. 16(*a*). FIG. 16(*c*) is a cross-sectional view of the nozzle unit 23 when cut along the xy plane at the position z2 shown in FIG. 16(*a*).

The nozzle unit 23 of Modification 6 has a tapered division portion 23*a* having a diameter that decreases from the inflow port toward the outflow port in the vicinity of the outflow port. Also, near the outflow port, an outer portion 23*b* that has an opening surrounding the division portion 23*a*, where the opening has a diameter which decreases from the inflow port toward the outflow port, is provided at the same position as the division portion 23*a*. The division portion 23*a* and the outer portion 23*b* are connected to each other by a support portion 23*c*.

In a case where the nozzle unit 23 provided with the division portion 23*a* and the outer portion 23*b* is used, when the sample flows into the vacuum chamber 4, it is divided into a plurality of flows by the support portion 23*c*, and it passes through an inclined groove between the division portion 23*a* and the outer portion 23*b*. As a result, a plurality of expansion waves crosses and interferes with each other in the vacuum chamber 4, and generation of the Mach disk can be suppressed.

As mentioned above, since the nozzle unit of Modification 6 has a structure in which the sample divided by passing through the inclined groove is crossed, the effect of suppressing generation of the Mach disk can be sufficiently obtained even if it does not have a configuration in which the gas flow is divided by making the central axis of the division portion 23*a* coincide with the central axis of the inflow port. Since the nozzle unit 23 of Modification 6 has a simple configuration in which the division portion 23*a* and the outer portion 23*b* connected by the support portion 23*c* are disposed in the vicinity of the outflow port, the advantage is that the system upstream of the outflow port is not need to be considered.

<Modification 7>

Figure 17:
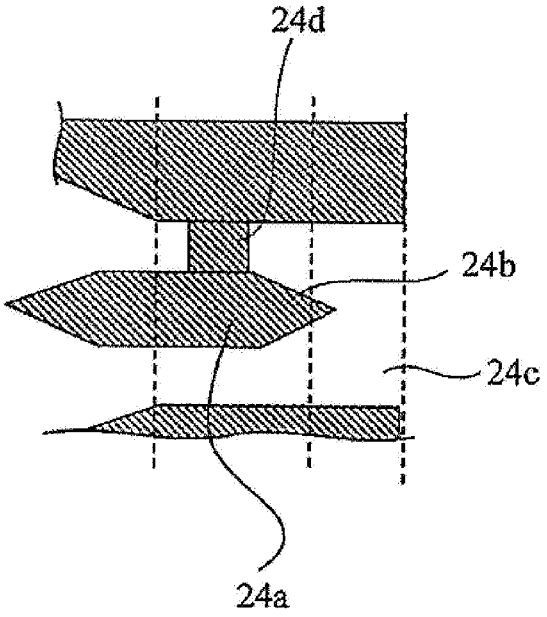
FIG. 17 is a cross-sectional view of a nozzle unit of Modification 7.

FIG. 17 is a cross-sectional view of a nozzle unit 24 of Modification 7. In the nozzle unit 3 of the embodiment, the tip of the projection 3*f* included in the division portion 3*c* is at the same position as the opening end of the outflow port 3*b*. On the other hand, in the nozzle unit 24 of Modification 7, the tip of a projection 24*b* included in a division portion 24*a* is closer to the inflow port than the opening end of an outflow port 24*c*. That is, there is a distance from the tip of the projection 24*b* to the outflow port 24*c*. The above configuration is realized, for example, by making a support portion 24*d* closer to the inflow port than the outflow port of the inner wall.

The divided sample each flows along the inclined surface of the projection 24*b* and crosses after the tip of the projection 24*b* and before the vacuum chamber 4. For this reason, the sample flow cancels out the components in the y-axis direction before flowing into the vacuum chamber 4, so that expansion of the expansion wave can be suppressed. That is, the nozzle unit 24 of Modification 7 can suppress the Mach disk.

<Modification 8>

In the mass spectrometer S of the embodiment, only one vacuum chamber 4 is provided between the nozzle unit 3 and the collision chamber 5. A plurality of vacuum chambers 4 may be provided so that the degree of vacuum increases stepwise. In this case, a radio frequency voltage may be applied by providing an ion guide electrode in each of the plurality of vacuum chambers.

<Modification 9>

In the mass spectrometer S of the embodiment, the mass analysis unit 6 has four electrodes. The number of electrodes that the mass analysis unit 6 has is not limited to four. The mass analysis unit 6 may include n (n is an integer of 2 or more) sets of rod-shaped electrodes to which a DC voltage Un and an AC voltage $Vn_{RF}COS(\Omega_{RF}+RF)$ are applied. In this way, ion selection performance is improved.

[Summary]

A division portion 3*c* for dividing the flow of the sample is provided inside the nozzle unit 3 provided in the mass spectrometer S, and the division portion 3*c* has the tapered projection 3*f* whose diameter decreases toward the outflow port 3*b*. The mass spectrometer S having the above configuration causes the flow of the divided sample to cross and flow into the vacuum chamber 4. The flow of the sample crossing each other cancels the reflected wave of the expansion wave and suppresses generation of the Mach disk.

Further, the projection 3*f* may have a conical shape. With this configuration, since the sample flows evenly toward the central axis at the end of the division portion 3*c*, it satisfactorily cancels the reflected waves of expansion waves, which suppresses generation of Mach disk.

For example, the central axis of the projection 3*f* and the central axis of the outflow port 3*b* substantially coincide with each other. With this configuration, since the shape of the outflow port 3*b* is symmetric about the central axis, it satisfactorily cancels the reflected waves of expansion waves, which suppresses generation of Mach disk.

The support portions 3*e* that support the division portion 3*c* may be provided on the inner wall of the nozzle unit 3 at a position closer to the inflow port 3*a* than the outflow port 3*b*. With this configuration, since the sample reaches the end of the division portion 3*c* with little turbulence in the flow, it satisfactorily cancels the reflected waves of expansion waves, which suppresses generation of Mach disk.

For example, the apex of the conical projection 3*f* is located closer to the inflow port 3*a* than the opening end of the outflow port 3*b*. With this configuration, after each of the divided flows of the sample fully crosses, it will flow into vacuum chamber 4. As a result, it is presumed that the reflected wave of the expansion wave is canceled well and generation of the Mach disk is suppressed.

The present invention is not limited to the embodiments described above, but includes various modifications. For example, the above-described embodiments have been described in detail for easy understanding of the present invention, and the present invention is not necessarily limited to embodiments having all the configurations described. Moreover, it is possible to replace part of the configuration of an embodiment with the configuration of another embodiment, and it is also possible to add the configuration of another embodiment to the configuration of an embodiment. Further, it is possible to add, delete, and replace another configuration with respect to part of the configuration of each embodiment.

In the present specification, the use of the nozzle unit 3 has been described by taking the mass spectrometer S as an example. However, the use of the nozzle unit 3 is not limited to the mass spectrometer. The nozzle unit 3 can be applied to all devices that move fluid between chambers having a pressure ratio of 50 times or more.

All publications and patent literatures cited in this specification are incorporated herein by reference in their entirety.

REFERENCE SIGNS LIST

S mass spectrometer
1 pretreatment unit
2 ionization unit
3 nozzle unit
3*a* inflow port
3*b* outflow port
3*c* division portion
3*d* central axis
3*e* support portion
3*f* projection
3*g* flow passage
4 vacuum chamber
5 collision chamber
6 mass analysis unit
7 ion detection unit
8 data processing unit
9 display unit
10 user input unit
11*a*, 11*b*, 11*c*, 11*d* electrode
12*a*, 12*b*, 12*c*, 12*d* electrode

13*a*, 13*b*, 13*c*, 13*d* electrode
14 voltage source
15 controller
16 nozzle unit
17 vacuum chamber
18 to 24 nozzle unit

The invention claimed is:

1. A mass spectrometer comprising:
an ionization unit that ionizes a sample;
a nozzle unit having an inflow port that is connected to the ionization unit by a flow pipe and through which the ionized sample flows, and an outflow port from which the sample flowing in flows out;
a vacuum chamber that is evacuated by vacuum evacuation means and into which the sample flows from the nozzle unit;
a mass analysis unit that is located downstream of a flow of the sample relative to the vacuum chamber and that selects ions from the sample; and
an ion detection unit that detects the ions selected by the mass analysis unit, wherein
a division portion that divides a flow of the sample is provided inside the nozzle unit, and
the division portion has a tapered projection whose diameter decreases toward the outflow port.

2. The mass spectrometer according to claim 1, wherein the projection has a conical shape.

3. The mass spectrometer according to claim 2, wherein a central axis of the projection and a central axis of the outflow port substantially coincide with each other.

4. The mass spectrometer according to claim 1, wherein the division portion has a substantially circular cross section.

5. The mass spectrometer according to claim 1, wherein a support portion which supports the division portion is provided on an inner wall of the nozzle unit at a position closer to the inflow port than the outflow port.

6. The mass spectrometer according to claim 1, wherein the division portion is supported by a plurality of support portions.

7. The mass spectrometer according to claim 4, wherein the division portion is supported by an annular support portion that has a boundary with an outer periphery of the division portion and an outer periphery of an inner wall of the nozzle unit, the annular support portion being provided with a plurality of holes.

8. The mass spectrometer according to claim 1, wherein a ratio P1/P2 between a pressure P1 in the flow pipe and a pressure P2 in the vacuum chamber is 50 times or more.

9. The mass spectrometer according to claim 1, wherein the mass analysis unit includes n sets of rod-shaped electrodes to which a DC voltage Un and an AC voltage $Vn_{RF}COS\ (\Omega_{RF}+RF)$ are applied where n is an integer of 2 or more.

10. The mass spectrometer according to claim 2, wherein a vertex of the projection is located closer to the inflow port than an opening end of the outflow port.

11. The mass spectrometer according to claim 1, further comprising:
an outer portion having an opening surrounding the division portion, the opening whose diameter decreases from the inflow port toward the outflow port having a tapered shape.

12. The mass spectrometer according to claim 1, wherein the division portion has an end closer to the inflow port, the end projecting relative to the inflow port.

13. A nozzle member used in a mass spectrometer, wherein
the nozzle member has an inflow port into which an ionized sample flows and an outflow port from which the sample flowing in flows out, and a division portion that divides a flow of the sample is provided inside the nozzle member, and
the division portion has a taper-shaped projection whose diameter decreases toward the outflow port.

14. A mass spectrometer comprising:
an ionization unit that ionizes a sample;
a nozzle unit having an inflow port that is connected to the ionization unit by a flow pipe and through which the ionized sample flows, and an outflow port from which the sample flowing in flows out;
a vacuum chamber that is evacuated by vacuum evacuation means and into which the sample flows from the nozzle unit;
a mass analysis unit that is located downstream of a flow of the sample relative to the vacuum chamber and that selects ions from the sample; and
an ion detection unit that detects the ions selected by the mass analysis unit, wherein
a division portion that divides a flow of the sample is provided inside the nozzle unit, and
the division portion causes the divided flow of the sample to cross and flow into the vacuum chamber.

* * * * *